United States Patent [19]

Lejdegård et al.

[11] 4,014,225

[45] Mar. 29, 1977

[54] POWER-DRIVEN SCREWDRIVER

[75] Inventors: Sixten H. Lejdegård, Ramnas; Nils E. Henriksson, Hallstahammar, both of Sweden

[73] Assignee: Bulten-Kanthal Aktiebolag, Sweden

[22] Filed: Mar. 24, 1975

[21] Appl. No.: 561,287

Related U.S. Application Data

[63] Continuation-in-part of Ser. No. 438,720, Feb. 1, 1974, abandoned.

[30] Foreign Application Priority Data

Feb. 2, 1973 Sweden ..... 7301423

[52] U.S. Cl. ..... 81/57.37; 144/32 R

[51] Int. Cl.[2] ..... B25B 23/02

[58] Field of Search ..... 81/57.37, 71, 177 B; 144/32

[56] References Cited

UNITED STATES PATENTS

| | | | |
|---|---|---|---|
| 2,328,383 | 8/1943 | Lea et al. | 144/32 |
| 2,770,269 | 11/1956 | Austin | 144/32 |
| 2,943,652 | 7/1960 | Chilton | 144/32 |
| 2,963,930 | 12/1960 | Clothier et al. | 81/177 A |
| 3,601,168 | 8/1971 | Fernstrom | 144/32 |

*Primary Examiner*—James L. Jones, Jr.
*Attorney, Agent, or Firm*—Hill, Gross, Simpson, Van Santen, Steadman, Chiara & Simpson

[57] ABSTRACT

A screw tightening apparatus comprising a motor-driven tool, a screw magazine for screws affixed to a strip-like carrier, and a screw advancing and tightening means for advancing the screws one at a time to a preparatory screw tightening position in which a bit portion of the motor-driven tool may engage with the screw for tightening thereof. The screw advancing and tightening means comprises two axially movable portions, one of which is secured to the tool and the other one of which carries the screw magazine and a spring biased screw advancing mechanism. A push and pull member on the stationary portion is adapted to cooperate with a dog means on the spring biased screw advancing mechanism for advancement of a new screw at the end of the retractive movement of the movable parts into a rest position, subsequent to a completed driving home of a screw. A latch holds the screw advancing mechanism temporarily in a retracted rest position during tightening of the screw and the first portion of the movement of the relatively movable portions into a retracted rest position and releases said screw advancing mechanism for advancement of a screw, at the final stage of said movement.

41 Claims, 11 Drawing Figures

POWER-DRIVEN SCREWDRIVER

RELATED APPLICATIONS

This application is a continuation-in-part of our copending application Ser. No. 438,720 filed Feb. 1, 1974, abandoned with the filing hereof.

BACKGROUND OF THE INVENTION

1. Field of the Invention

This invention is directed to a power-driven screwdriver for use with a strip of screws.

2. Prior Art

It has been known heretofore to secure plasterboard by nails or screws, screws being preferable. In doing so, the tradesman selects a screw carried in a pocket of an apron that he wears, and holds such screw in position by hand. It has then been known to use a power-driven screwdriver to advance the same to secure the plasterboard on the wall or on the ceiling of a room. Under such conditions, it has not been uncommon to drop a screw. Frequently, it is uneconomic to stop work to retrieve such dropped screw. The workman may be working on stilts or may be on a scaffold near the ceiling, and at any event, his labor rate is such that the practice prevailing today is not to pick up any dropped screw. One realistic estimate is that 15 percent of the screws are dropped and not retrieved. Further, screws can fall from the apron, and the screw loss from all causes is not negligible.

Another difficulty with such type of tradesman activity is that the screw has sharp threads in that it is self-tapping and therefore, the tradesman gets sore fingers.

Further, using the technique described above, an average production rate for an experienced workman is to use about 5 seconds for each screw applied.

Further, to practice the technique described above, with one hand holding the screw, the other hand is used to hold the power screwdriver which, at least, is awkward, due to its length.

Further, using the technique described above, there is frequently a lack of precision in perpendicularity which tends to possibly make work look unprofessional or possibly be weaker than it should be, and this problem also adversely affects the life of the screwdriver bit.

Further, under the technique described above, using power apparatus, it is not always possible to have reliability in the control of the depth that the screw is applied.

SUMMARY OF THE INVENTION

In accordance with the present invention we have provided a power-driven screwdriver that is adapted to work with a strip of screws, such as carried in a storage magazine, and the screwdriver or applicator automatically indexes the screws. With this invention, no screws are carried in an apron so there can be no loss therefrom, and no screws are held by hand and thus none can be dropped, thereby eliminating that loss. Since none are held by hand, the sore-finger problem is also eliminated. Further, the time required for a tradesman to apply a screw is reduced to an average of about one and a half seconds each, which is less than one-third the former time. Since one hand does not need to hold the screw, both hands can be used on the power screwdriver making it easier to hold and easier to achieve perpendicularity of screws. Further, there is a flat guide face applied directly against the workpiece which further assists in assuring perpendicularity of the screw. The device has some length, but both hands can be well away from the point where the screw emerges, and therefore it enables many a tradesman to reach the ceiling without use of stilts or scaffolding, merely reaching the ceiling directly with this new tool. Because of the improved perpendicularity, screwdriver tool-bit life has been increased fifty percent on the average, and there is excellent depth of control that can be adjusted into a particular device having in mind the materials and workpiece that the device is working with.

In accordance with the present invention, the screwdriver has a body that engages the workpiece and which supports appropriate screw storage and guiding means as well as means for indexing screws to the operative position. A motor-driven screwdriver bit is carried on a plunger member which is reciprocably carried on the body. The mechanism is responsive to the reciprocable movement of the plunger, and on retraction of the bit, index means advance the next screw. The index means are cocked as a consequence of driving such next screw into position in the workpiece.

Accordingly, it is an object of the invention to provide means by which screws can be applied and tightened in an efficient manner.

A further object of the present invention is to provide means by which a tradesman can apply screws to a workpiece without handling the screws per se.

Other objects include the elimination of the disadvantages discussed above.

A further object is to avoid the need for an air compressor on the site of construction.

A still further object is to provide a portable automatic screw fastener which will operate in any attitude by virtue of its not being position sensitive.

Many other advantages, features and additional objects of the present invention will become manifest to those versed in the art upon making reference to the detailed description and the accompanying sheets of drawings in which a preferred structural embodiment incorporating the principles of the present invention is shown by way of illustrative example.

ON THE DRAWINGS

Figures 1, 6:
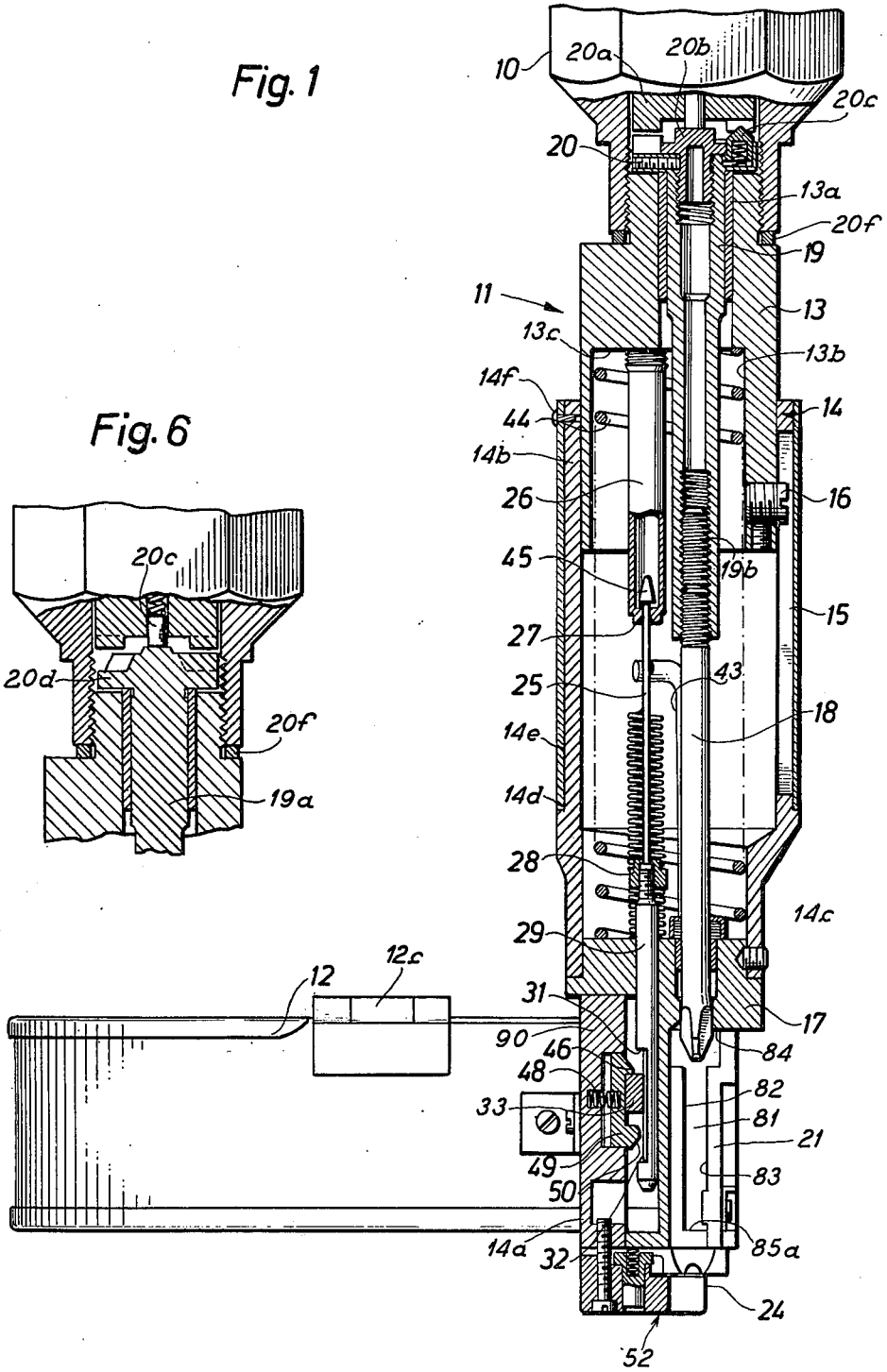
FIG. 1 is a cross sectional view of a power-driven screwdriver, partly broken away, taken along line I—I of FIG. 3, provided in accordance with the present invention.
Figures 2, 11:
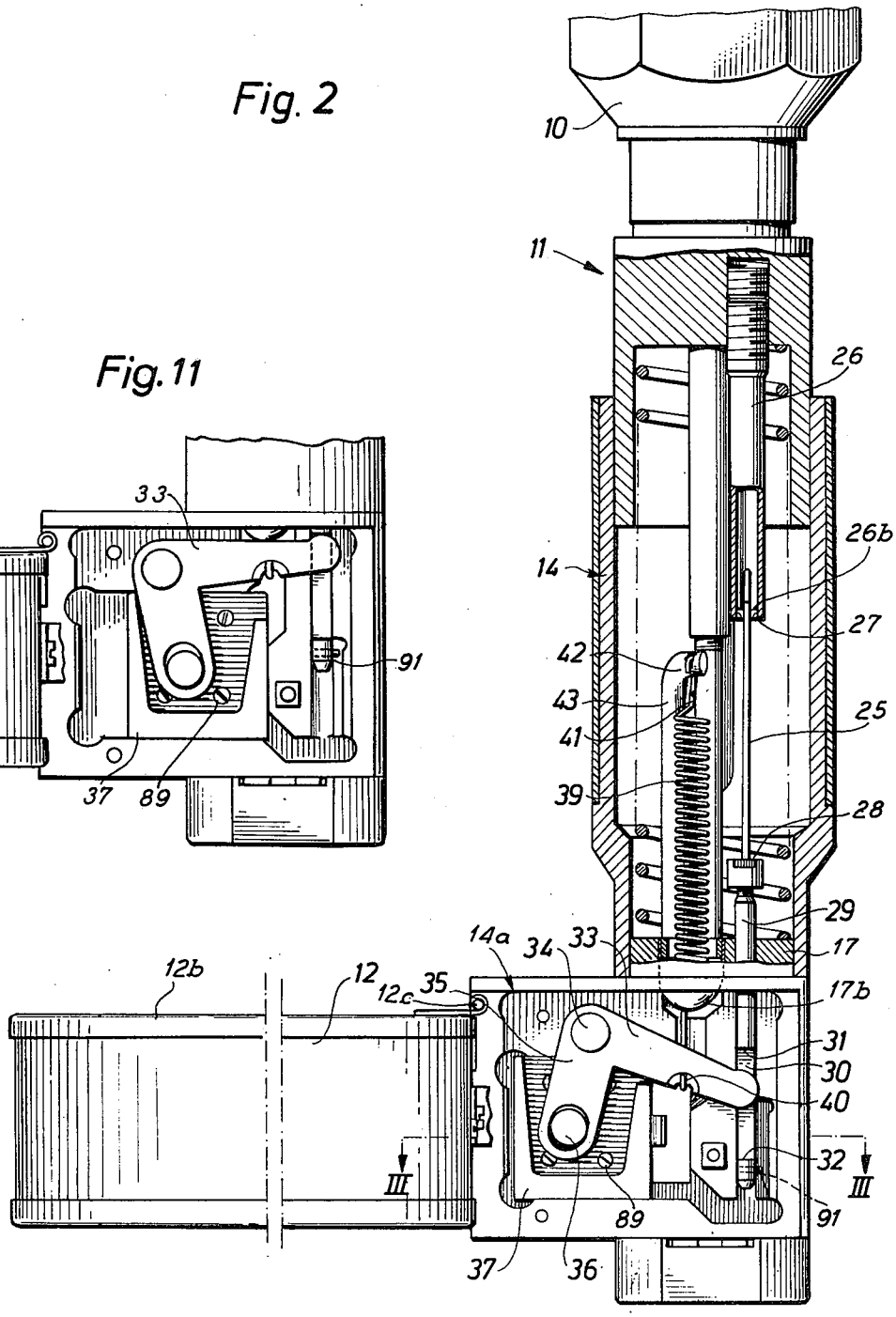
FIG. 2 is a similar view taken along line II—II of FIG. 3 with a cover removed and illustrating certain internal components in a cocked position, ready to feed a screw. This view is also a view of the structure as shown in FIG. 1, viewed from the left side and with a cover removed.
Figure 3:
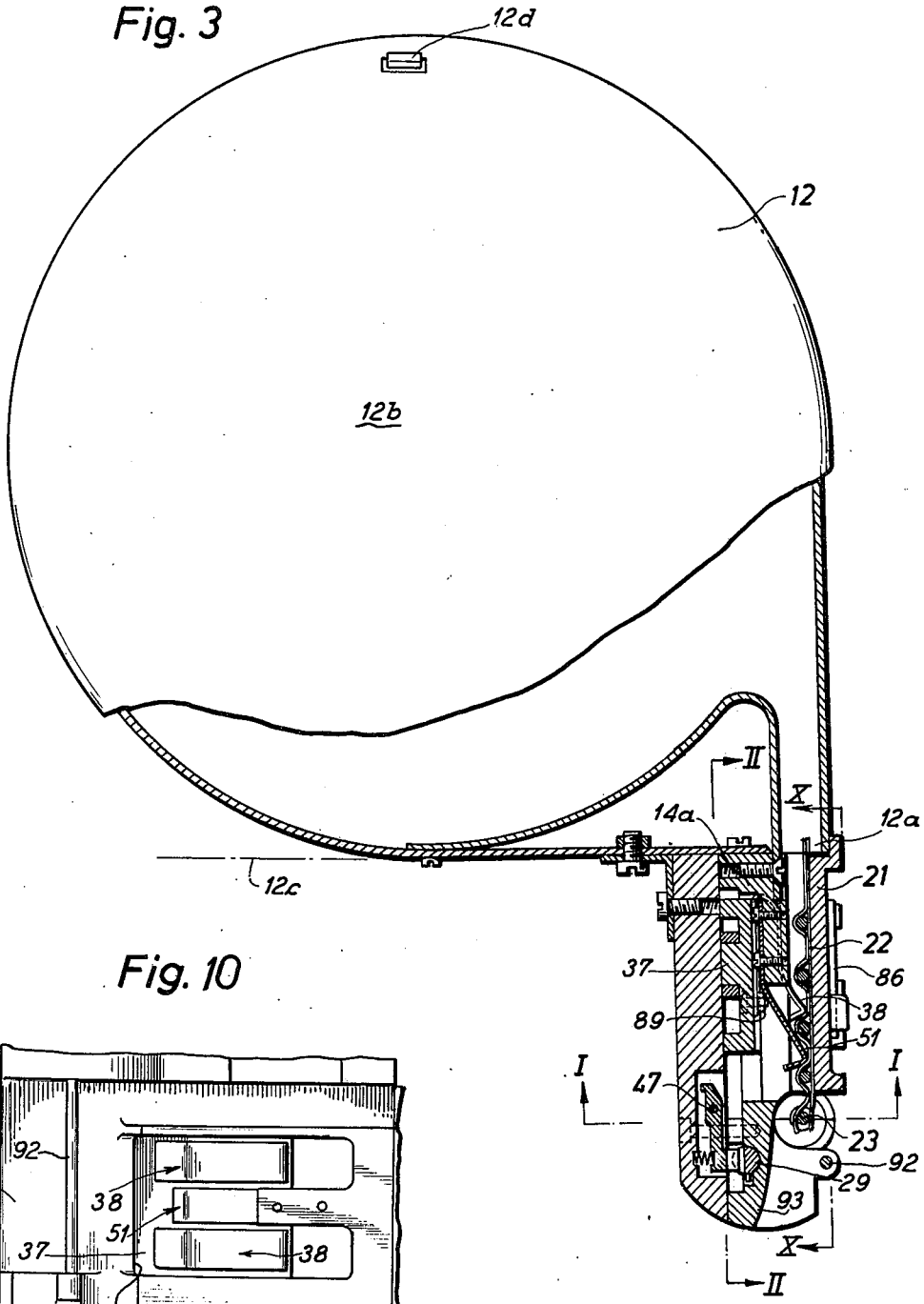
FIG. 3 is a view taken along line III—III of FIG. 2, partially in elevation, and with the cover restored.
Figure 10:
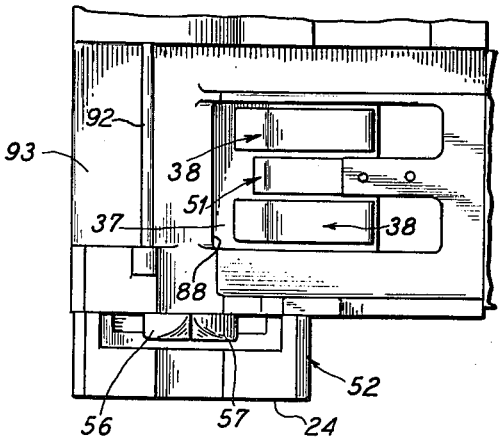
Figure 4:
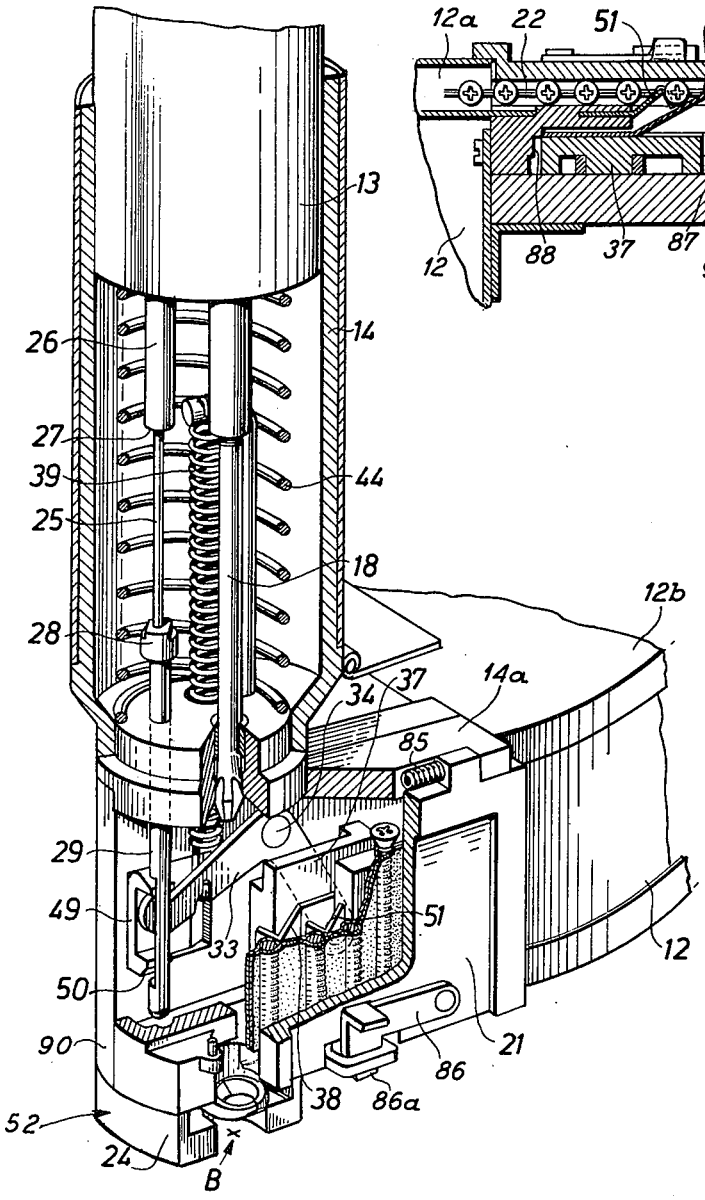
FIG. 4 is a fragmentary perspective view, partly in section and partially broken away showing the device primarily from the right side of FIG. 1.
Figure 7:
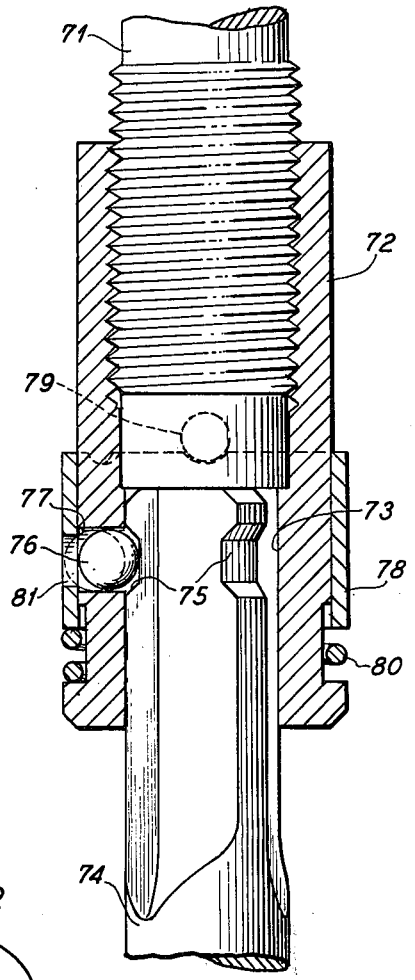
Figure 8:
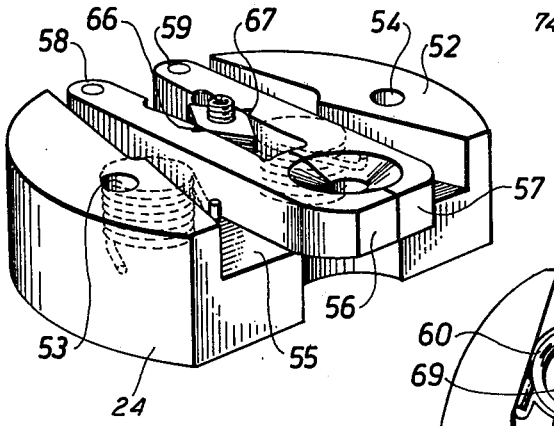
Figure 9:
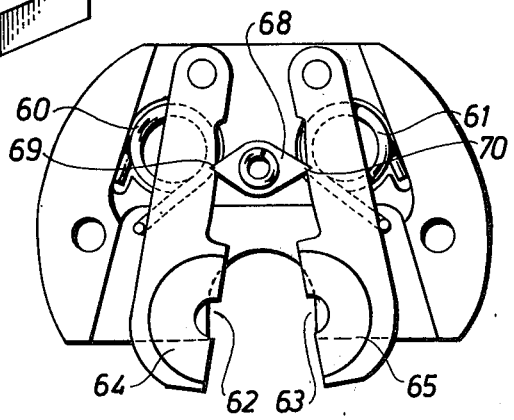

FIG. 6, appearing with FIG. 1, is an enlarged fragmentary cross sectional view showing an alternate construction for a portion of FIG. 1;

FIG. 7 is an enlarged fragmentary view, partially in cross section, showing a further modification for another portion of FIG. 1;

FIGS. 8 and 9 show a guide for the screw tip in a closed and in an open position, the same being the lowermost portion of the device in each of FIGS. 1, 2 and 4;

FIG. 10, appearing with FIG. 3, shows the structure at the lower right side of FIG. 1 and in the lower foreground of FIG. 4 but with a door open; and FIG. 11, appearing with FIG. 2, is a fragmentary portion thereof showing the parts in the uncocked or screw-advanced position, with the screw ready to be driven into the workpiece.

AS SHOWN ON THE DRAWINGS

This invention is particularly useful when embodied in a power-driven screwdriver of the type shown and described herein. The device is driven by a motor-driven tool or device, constructed in the nature of an electic drill without the chuck. Electric operation is preferable since need for compressed air is avoided, but the broader aspects of the invention include any source of suitable power, and this element is of any conventional design.

The structure secured to the motor-driven tool 10 is collectively referred to herein as screw tightening and advancing mechanism generally indicated at 11. The mechanism 11 includes a body 14 to which is secured a screw magazine 12, the body being receptive of a plunger-like member or unit 13 that is reciprocably slidable therein. There is both a mechanical connection between the motor-driven device 10 and the plunger 11 as well as a rotatational connection with structure in the plunger member 13, described below. The body 14 has a base portion **14*a* and a cylindrical portion 14*b* which is tubular and thus serves as a hand gripping portion. The plunger member 13 is partially hollow and contains and supports drive means for transferring both manual power and work force to the screw. The connection for rotational power includes a face clutch 20 which has a drive face 20*a* rotatably driven by the motor and a driven face 20*b*, being the part of the clutch 20 which is secured to a spindle 19 to which is affixed a screwdriver or screwdriver bit 18. The spindle 19 is rotatably supported in the plunger 13 by a bearing 13*a*. The plunger 13 also is partially hollow as at 13*b*, thereby providing an internal shoulder 13*c* against which the upper end of a spring 44 acts. The lower end of the spring 44 acts against an internal shoulder 14*c* within the tubular portion 14*b* of the base 14 there thus being a cylindrical compartment between the shoulders 13*c* and 14*c* accommodating and guiding the spring 44. The spring urges the plunger 13 in an outward direction from the cylindrical portion of the body 14. The cylindrical portion 14*b* has a pin and slot connection with the plunger, the same being shown as a guide pin or screw 16 in the plunger 13 and an elongated slot 15 in the body 14. The pin 16 engages the upper end of the slot to limit retraction of the plunger and engages the lower end of the slot 15 to limit advance of the plunger, and the sides of the projecting portion of the pin 16 engages the sides of the slot 15 to prevent any relative rotation therebetween. The pin and slot connection 15, 16 thus also limits the normal retraction and extension of the bit 18 as the spindle 19** is carried thereon.

The clutch 20 has a spring loaded pin **20*c* which yields to enable the clutch to mesh when sufficient reactive force has been applied by the workpiece to the opposite end of the device. If desired, the driven clutch face 20*b* can be made integral with the spindle 19 as shown at 20*d* and 19*a* in FIG. 6, appearing with FIG. 1. Further, the spring loaded pin 20*c* can project out of either clutch face and can be centered as shown at 20*e* in FIG. 6. A shim 20*f* surrounds the threaded portion of the plunger 13 and has a thickness that provides the proper clearance for the clutch faces 20*a*, 20*b*** when they are disengaged.

The lower end of the spindle 19 is threaded and receives a jam nut **19*b* which is selectably positioned so that when the upper threaded end of the bit 18 is screwed thereagainst, the bit 18** will have the correct effective length.

An alternative structure for connecting the bit to the spindle is shown in FIG. 7. Here, a spindle 71 is threaded at its lower end, and an internally threaded sleeve 72 is turned tightly thereon, the sleeve projecting downwardly beyond the end of the spindle to provide a socket 73 into which the upper end of a bit 74 projects. The portion 73 is a socket that has a non-circular horizontal cross section which opens axially to receive the spindle, the spindle here having three flutes or splines of corresponding cross section, each one notched at 75 for reception of a locking ball 76 disposed in a radial aperture 77 in the lower part of the sleeve 72. The ball 76 is surrounded by a ring 78 which is urged against a radial pin 79 by a spring 80. The ring 78 has a pair of notches at its upper edge, each receptive of the pin 79. When the ring 78 is rotated to be in the position shown, an aperture 81 in the ring registers with the ball 76 enabling it to move radially outwardly as shown in broken lines, thereby releasing the bit 74. The ring stays in this position because of the detent pin 79. To lock the bit, the ring 78 is rotated so that the other notch registers with the detent pin 79, thereby bringing an imperforate portion of the ring 78 into registration with the ball 76, thereby holding it positively in the position shown in solid lines.

By the foregoing description, motor power can be applied to the bit 18 or 74 to rotate it, and the operator can advance the plunger at the rate that the screw goes into the workpiece. The amount of mass between the clutch and the screw is minimized so that there is a minimum of flywheel effect derived from the spindle, and even such advance is limited by virtue of the pin and slot connection 16 because the screw will simply "walk" away from the bit tip if it tends to turn too far into the workpiece. With the screw fully driven in, the plunger 13 is retracted.

The advance of the plunger 13 and its retraction is also utilized to effect synchronized screw feeding to place the next screw in position to be driven. To this end, secured to the plunger 13 is an impact member 26, also referred to herein as a push and pull member. The impact member 16 is hollow and has an end face 26 directed toward and engageable with an oppositely facing upper end face 28 of a dog 29. When the impact member 26 is moved toward the dog 29, nothing happens until the end faces engage each other, and thus this clearance provides a form of lost-motion connection. Another form of lost-motion connection is provided between these parts by a pull rod 25, one end of which is secured to one of the end faces 28 and the other end of which projects through an opening in the other end face 27 surrounded by an internal shoulder **26*b*, the pull rod 25 having an enlarged head, bend, or head portion 45 engageable with the internal shoulder 26***b*.

When the plunger 13 is advanced into the body 14, the upper end of the push rod 25 merely passes into the impact member 26 until its lower end 27 engages the upper end or head 28 of the dog 29. FIG. 1 is actually drawn to show a transient condition near the full retraction of the bit 18. At the outset, the plunger 13 projects outwardly a little more with the pin 16 engaging the upper end of the slot 15 and the dog 29 is likewise in an initially higher position where it is held by structure described later herein. At any event, the plunger 13 advances and transmits no force to the pull rod 25. During this advance, the bit 18 moves from its fully retracted position to the position where drawn at which point it engages the next screw to be driven, and then for a substantial additional travel, the push rod continues to move into the impact member 26 as the screw is being advanced into the workpiece. During the latter part of that travel, the end face 27 will engage the end face 28 and move the dog 29 downwardly to be trapped by structure described later herein. Then the bit is withdrawn so that at the position illustrated in FIG. 1, the bit 18 has been retracted so as to be out of the space to be occupied by the next screw to be fed. At this point, the formation 45 engages with the internal shoulder 26*b* and begins to pull the dog 29 upwardly to enable it to actuate mechanism described below. Thus by means of the impact member 26 and the dog 29 with its two lost-motion connections, the dog 29 is controlled to store power in a spring described later at the right time, and the retractive movement is sensed to release such spring power at the right time in correlation with the position of the bit 18.

The cylindrical compartment in the cylindrical body portion 14b is separated from a compartment in the base portion 14*a* by an intermediate wall 17 which also functions as a bracket and as a guide means. The wall 17 has three openings. One of these functions as a guide or bearing or slidable support for the dog 29, another performs similar functions for the bit 18 aided by a bearing insert and dirt seal as shown. The wall 17 also provides the support for an upright 43 having a bent-over end or similar formation 42 by which, as best seen in FIG. 2, the upper hook end 41 of a spring 39 is supported. Wall 17 has an aperture through which the lower end of the spring 39 projects, its lower end being formed as a hook 40, there being an aperture dirt seal 17*b*, best seen in FIG. 2, through which the spring end 40 projects.

The bracket or wall 17 has a cut-away diameter which defines a flange, the lower end of the cylindrical portion 14*b* being received thereon for abutment against such flange, these parts being securely held together. The cylindrical portion of the body 14*b* is also shouldered at 14*d* for receiving a sleeve 14*e* by which the slot 15 is closed. The sleeve 14*e* is appropriately secured as by a fastener 14*f* shown in FIG. 1.

As shown in FIG. 2, the impact member 26 is also threaded against a jam nut in the plunger 13 whereby its effective length can be selected.

The magazine 12 is secured to the base portion 14*a* of the body 14 and it has an outlet 12*a* through which the outer end of a strip of screws 22, arranged in roll form can pass to guide means described below. The magazine 12 has a cover 12*b* arranged to pivot about a hinge or hinge axis 12*c*. A spring latch 12*d* keeps the cover 12*b* in a closed position with sufficient force so that even if the device were turned so that its full contents rested on such cover, the latch 12*d* holds anyway.

The body 14 has guide means for guiding the strip of screws 22 from the magazine to a position in registration with the rotational axis of the bit 18. The strip of screws 22 passes through a channel of generally rectangular cross section which extends in the body 14 from the magazine to a point that is close to the next screw that is to be advanced, such longitudinal extent being shown in FIGS. 3 and 5. In FIG. 1, the channel is indicated at 81 and is defined by four surfaces 82,83,84 and 85*a*. The guide surfaces 82 and 83 are parallel to the rotational axis of the bit and their upper marginal portions that are parallel to the strip and which are closer to the retracted bit position are undercut to provide guidance for the screw heads, and an opposite marginal portion on the surface 83 that is parallel to the strip length projects into the channel 81 for acting on the tapered tip of the screw. Access to the channel 81 is provided by a lid or door 21 which is pivoted on the base portion 14*a*, there being a torsion spring 84 disposed around the pivotal axis of the door and tending to urge the door 21 to an open position. The guide surface 83 and is recessed and projecting marginal portions are on the inner surface of the door 21. The door 21 supports a pivoted door latch 86 which, as best seen in FIG. 4, has a portion that projects into an opening on the base portion 14*a*. The portion 86*a* of the door latch 86 that extends beyond the opening is enlarged in the direction that the spring 85 urges the door to move; therefore the finger that has the enlarged tip 86*a*, coupled with the assistance of the spring 85, holds the pivoted latch from pivoting due to gravity when the screw is being driven into the ceiling.

Figure 5:
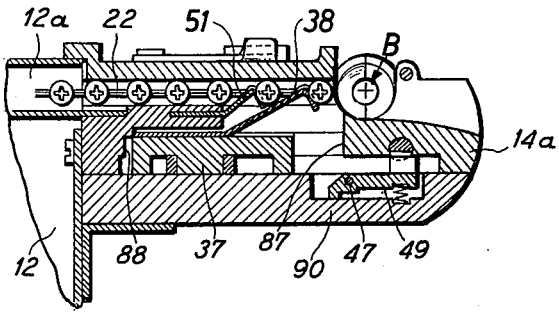
FIG. 5 is a framentary cross sectional view corresponding generaly to a portion of FIG. 3 but taken just above the heads of the screws and showing the structure in larger detail.

In order to load the device with a strip of screws, a strip or row is placed in the magazine and unwound so that an end comes through the outlet 12*a* and the door 21 is opened and the strip 22 is placed into the guide means with the endmost screw 23 in alignment with the rotational axis of the bit 18 as shown in FIG. 3. If the strip 22 is placed as shown in FIG. 5, no screw will be driven into the workpiece on the first cycle. The door 21 is then closed, and the first screw can then be driven into the workpiece by the structure thus far described.

There is a further or second guide means on the body that guides the axially driven screw which is constructed in the form of an attachment 52 secured to the body 14 as best seen in FIGS. 1 and 4. The attachment 52 is shown in perspective in FIG. 8 by itself and includes a nose portion 24 having a pair of screw holes 53,54 a recess 55 therebetween within which there is a pair of pivoted jaws 56,57 carried on the nose portion 24 by a pair of pivot pins 58,59 there being a pair of coil springs 60,61 respectively urging the jaws 56,57 together. The jaws 56,57 respectively have semi-circular recesses 62,63 therethrough which flare into conical recesses 64,65 that are directed toward the screw to be fed. If desired, the jaws 56,57 may each be provided with a small recess or latching groove 66,67, there being a latching member 68 having a pair of oppositely directed pointed edges 69,70 receptive in the recesses 66,67 when the latching member 68 is turned. The normal operating position is shown in FIG. 8, but the latching member can be turned with a tool from the side opposite to that shown to take the position shown in FIG. 9 wherein the jaws are retracted. The retraction facilitates replacement of the screwdriver bit 18.

In normal use, the attachment 52 is so secured to the body that the opening defined by the recesses 62,63 registers with the rotational axis of the screw 23 that is next to be fed, as best seen in FIG. 3. Preferably, the shape of the conical recess 64,65 conforms to that of the underside of the screw head, and the screw opening 62,63 is a little larger than the screw body. By this structure, the tip of the screw is precisely guided to the exact spot that the screws should enter the workpiece, the nose portion 24 being flat and serving as a guide to the user for assuring him that the screw will be driven perpendicularly to the support surface.

As the bit 18 is retracted, index means are actuated to advance the strip 22 to place the next screw in line with the bit. As seen in FIGS. 5 and 10, index means are provided on the body portion 14*a* for laterally shifting the strip 22. (These have been omitted from FIG. 1 for reasons of clarity but are shown in FIGS. 3, 5 and 10.) A slider 37 is slidably guided for movement to the left and the right as shown in FIG. 5 by means of appropriate guide surfaces in the base portion 14*a*. When the propelled to the right, beginning from the left, a pair of driving finger means 38 in the form of resilient leaf springs have a driving face that will act against the next screw to be fed just before the bit has been fully retracted to shift the entire strip 22. If desired, the device may be built to work on the next to the last screw, but that would always leave one screw in the device. Between the two driving fingers 38, there is disposed a stop finger means 51 fixed to the base portion 14*a* of the body and as the strip is driven, a succeeding screw will engage a camming face on the finger 51, and the finger 51 will yield to permit that screw to pass over it during such retractive action or movement. When the bit is being driven forward, the slider 37 moves from the right to the left as shown in FIG. 5 and a stop face on the finger 51 abuts a screw and prevents the strip 22 from moving backward, while a camming face of greater slope on the two driving fingers pass over the next screw to be fed and drop behind it as shown in FIG. 5. The slider 37 thus is guided by the body to reciprocate in response to operating means described below, there being a pair of stop faces 87,88 against which the slider 37 can abut. Engagement between the slider 37 and the stop 88 terminates the indexing or lateral shifting of the strip. The resilient fingers 38,51 have a free position such that even without the presence of the strip, they would engage the door 21 with some preloaded force. Thus when the door latch 86 is released, the springs 38 assists the spring 85 in the initial opening of door 21.

The mounting of the resilient fingers 51,38 is somewhat diagrammatic in FIG. 5 but has been shown in the manner for ease of understanding. The stop finger is secured to the base and the drive fingers 38 are secured to the slider 37. However, in FIG. 3, the arrangement is more accurately illustrated. The stop finger 51 is, as before, secured by a pair of screws to the base portion 14*a* and the drive fingers 38 extend in slots on either side of the stop finger and then have a 180° bend along with a return portion disposed against the slider 37 where each finger 38 is secured by a screw and nut 89 carried by the slider 37. FIG. 10 is helpful for an understanding of this arrangement.

There follows now a description of the structure by which the reciprocable movement of the plunger member effects the reciprocable movement of the slider 37. As seen in FIG. 1, the base portion 14*a* has what amounts to two compartments, one of which is the channel for the strip of screws and the other of which contains the mechanism about to be described within which the slider is disposed, the slots referred to earlier enabling the resilient fingers disposed in one such compartment to project through an intermediate wall for engaging the strip of screws in the other compartment. The base portion 14*a* has a cover 90 which has been removed from FIGS. 2 and 11 to enable viewing of the structure disposed in such compartment. As seen in each of FIGS. 1 and 2, the dog 29 has a recess or cutout portion 30 that defines an upper abutment 31 which faces away from the impact member 26 and a lower abutment 32 which faces toward the impact member 26. Disposed between the abutments 31,32 is a lever, here in the form of a bell crank, which converts the plunger motion in one direction to the slider motion in a direction at right angles thereto. The lever is carried on a pivot pin 34. One of its arms 35 has an aperture that is slightly elongated which is receptive of a peg 36 on the slider 37, while the other lever arm 33 is engaged by the end 40 of the spring 39, its distal end being disposed in the recess 30. The spring 39 biases the lever 33 counterclockwise as shown in FIG. 2 to tend to move the strip in an advancing direction. Under the influence of the impact member 26, the dog 29 acting through its abutment 31 engages the end of the lever 33 and rotates it clockwise to the position shown in FIG. 2 and better seen in FIG. 4 until such end of the lever 33 engages a cam surface on the upper end of a latch 49. The latch 49 is pivoted on the body cover 90 about a pivot axis that is parallel to the axis of the bit rotation as best seen in FIG. 5. As seen in FIG. 1, the abutment 31 has driven the lever arm 33 downwardly to a point where the lower edge of the lever arm engaged an upper cam surface 46 causing the latch 49 to pivot against the force of its spring 48 and thus trap the lever in the recess. Thus, the plunger advance preloads the spring 39 and retracts the slider 37 until the dog 29 has moved the lever 33 into a position where it is trapped by the latch 49, all of this taking place just before the end of the inward movement of the plunger.

On retractive movement of the plunger and bit 18, the plunger 13 must first retract for a distance corresponding to the length of the pull rod 25. The dog 29 up to then has been sort of floating but when the lost-motion connection is re-established, further retraction causes the dog 29 to be pulled outwardly until the abutment surface 32 engages the lower caming surface 50 on the latch 49. Note that the camming surface 50 projects further into the path of the dog, and when the abutment 32 engages the camming surface 50, the latch 49 pivots from the position shown in FIG. 1, to the left, thereby releasing the lever 33 under the force of the spring 39 to pivot rapidly from the position shown in FIG. 2 to the position shown in FIG. 11 to advance the next screw to a point of alignment with the bit 18.

As shown in FIGS. 2 and 11, the dog 29 has a pin and slot connection between it and the body 14*a* to prevent the rotation of the dog 29.

As seen in best profile in FIG. 3, there is disposed on the base portion 14*a* a separator rod 92 and a convexly curved portion 93. The strip 22 in this embodiment comprises two strips of paper between which the screws are affixed. As the screw 23 is driven out and the next one indexed to operating position, the separator rod is disposed to pass between the spent strips, thereby minimizing the likelihood of spent paper being carried along with the screw, the curvature 94 aiding in the guidance of the spent strip.

Although various minor modifications might be suggested by those versed in the art, it should be understood that we wish to embody within the scope of the patent warranted hereon, all such embodiments as reasonably and properly come within the scope of our contribution to the art.

We claim as our invention:

1. A power-driven screwdriver for use with an assemblage of screws affixed to a strip-like screw-carrying medium, comprising:

a. a body engageable with a workpiece;

b. a screwdriver bit mounted in said body for rotational and axial movement therein, and having drive means by which said bit may be rotatably driven;

c. stationary guide means on said body for guiding an end portion of the assemblage of screws remotely from the axis of said bit such that the next-to-be driven screw is guided and supported only by the strip-like medium in registration with said bit to be detached therefrom and driven into the workpiece by said bit; and d. automatic index means on said body for normally holding said end portion of the assemblage of screws against movement in either direction in said guide means, and operative on the screw-carrying medium to apply an indexing force thereto, only after and under the control of the axial retractive movement of the bit, for the distance needed to advance the next of the screws into said registration.

2. A screwdriver according to claim 1 including second guide means secured to said body in normally spaced relation to all the screws, but engageable by and receptive of the tip of a screw as it is axially driven from the screw-carrying medium before it is fully detached therefrom, whereby the driven screw is subsequently driven through said second guide means.

3. A screwdriver according to claim 2 in which said second guide means comprises a pair of axially stationary radially movable coacting jaws jointly defining a passage for the screw, and spring means urging said jaws together.

4. A screwdriver according to claim 3 in which said jaws further define a cam surface engageable by the screw tip leading to said passage, and having a shape corresponding to the under side of the head of the screw.

5. A screwdriver according to claim 3 including a movable latching member disposed between said jaws to hold them apart for replacement of said bit.

6. A screwdriver according to claim 3 in which said second guide means includes a nose portion supporting said jaws and said spring means, and detachably secured to said body, whereby said second guide means is removable therefrom as a unified assembly.

7. A screwdriver according to claim 1, said body having a stationary hand-gripping portion formed as a tubular extension encircling said bit, and a plunger member supporting said drive means and slidably non-rotatably mounted within said tubular extension.

8. A screwdriver according to claim 1 in which said automatic index means comprises:

a. operating means responsive to the retractive movement of said bit;

b. a slider guided by said body for reciprocable movement in the direction of the length of the assemblage and connected to said operating means to be driven thereby;

c. resilient driving finger means having a driving face for acting on the assemblage in the direction of its length at a screw in the assemblage advancing direction during retractive movement of said bit, and a camming face for passing by a screw in the assemblage during advancing movement of said bit, said driving finger means being secured to said slider; and d. resilient stop finger means fixed to said body and having a stop face acting on the assemblage at a screw in the assemblage during advancing movement of said bit, and a camming face passed over by a screw in the assemblage during retractive movement of said bit.

9. A screwdriver according to claim 7 which includes a pin and slot connection in said plunger member and said body for preventing relative rotation therebetween and for limiting the travel of said bit in both said axial directions.

10. A screwdriver according to claim 7 in which said automatic index means comprises:

a. means for laterally shifting the assemblage b. means responsive to the relative positions of said body and said plunger member and connected for reciprocating said assemblage-shifting means.

11. A screwdriver according to claim 10 in which said operating means comprises:

a. an impact member secured to said plunger member body;

b. a lever pivoted on said body and coupled to said shifting means;

c. a spring biasing said lever in a strip-shifting direction;

d. a latch on said body for trapping said lever in a spring-loaded position; and e. a dog slidably disposed on said body and having a lost-motion connection with said impact member, said dog being engageable with said lever and with said latch, whereby said impact member, acting through said lost-motion connection, loads said spring and traps said lever by said latch during bit advancement, and said impact member acting through said lost-motion connection releases said latch during bit retraction.

12. A screwdriver according to claim 11 in which said pivoted lever comprises a bell crank so that movement of said plunger member in one direction is converted to movement of said shifting means in a direction at a right angle to said one direction.

13. A screwdriver according to claim 11 including a post on said body to which one end of said biasing spring is supported.

14. A screwdriver according to claim 11 in which said latch is spring-biased for pivoting about an axis parallel to the axis of rotation of said bit.

15. A screwdriver according to claim 11 in which said latch has a cam surface engageable by said pivoted lever preparatory to the lever's being trapped.

16. A screwdriver according to claim 11 in which said latch has a cam surface engageable by said dog to effect release of said pivoted lever.

17. A screwdriver according to claim 11 in which said first lost-motion connection comprises an end face on said dog and an end face on said impact member which are normally spaced apart and engageable with each other during bit advancement, and a pull rod fixed at one end to one of said end faces, and extending slidably through an internally shouldered opening in the other of said end faces, and having a formation for engaging such internal shoulder.

18. A screwdriver according to claim 11 in which said dog has an abutment away from said impact member, and engageable with a portion of the pivoted lever.

19. A screwdriver according to claim 11 in which said dog has an abutment facing toward said impact member and engageable with a portion of said latch.

20. A screwdriver according to claim 11, said tubular hand gripping portion having a cylindrical compartment within which said bit and said spring are disposed, and a base portion carrying said guide means and having a further compartment enclosing said lever and said shifting means, there being a wall separating said compartments, said dog extending therethrough and being slidably guided thereby, and a portion of said spring extending through said wall.

21. A screwdriver according to claim 20 including a dirt seal between said compartments through which a portion of said biasing spring extends.

22. A screwdriver according to claim 20 in which said base portion of said body includes a cover supporting said trapping latch and enclosing a side of said further compartment.

23. A screwdriver according to claim 11 including a pin and slot connection between said dog and said body for precluding rotation of said dog about its displacement axis.

24. A screwdriver according to claim 1 in which said body has a convexly curved portion over which spent screw-carrying medium, used to hold the screws in alignment with said bit, may pass.

25. A screwdriver according to claim 1 which includes a separator rod secured to said body and disposed to be between spent strips of screw-carrying medium used to hold the screws jointly in alignment with said bit.

26. A screw tightening apparatus of the type comprising a motor-driven tool, a screw magazine for screws which are affixed to a strip-like screw carrying medium, and a screw advancing and tightening means for advancing the screws one at a time to a preparatory screw tightening position in which a bit portion of the motor-driven tool may be brought into engagement with the screw for tightening thereof, wherein the screw advancing and tightening means comprises two relatively axially movable but relatively non-rotatable portions, one of which is secured to the motor-driven tool, and the other one of which carries the screw magazine and a spring biased screw advancing mechanism, and wherein the stationary portion is provided with a push and pull member, adapted to cooperate with a rod shaped dog means of said spring biased screw advancing mechanism on tightening of a screw and to trigger said screw advancing mechanism for advancement of a further screw at the end of the retractive movement of said movable parts into a rest position, subsequent to a completed driving home of a screw.

27. A screw tightening apparatus as claimed in claim 26, wherein said dog means is telescopically movable into said push and pull member and has, at the inner end thereof, a head against which said push and pull member acts on pulling to tension said screw advancing mechanism.

28. A screw tightening apparatus as claimed in claim 26, wherein said dog means is adapted to actuate said screw advancing mechanism by means of a pivotally journalled bell crank, one lever of which engages into a recess of the dog means, and the other lever of which is pivotally connected to an advancing slide which is reciprocally slidable perpendicularly to the direction of movement of said dog means and has an advancing means for the screws.

29. A screw tightening apparatus as claimed in claim 28, wherein a spring biased latch is adapted to engage over said one lever of the bell crank during the tightening of a screw and the first portion of the retractive movement of the screw tightening apparatus to thereby momentarily lock said bell crank in a rest position wherein said bell crank is in a rest position wherein said advancing slide occupies a retracted start position, and which latch is adapted to be moved aside into a releasing position by means of an abutment of the dog means at the end of the retractive movement of said movable portions into a rest position to thereby permit said bell crank to pivot in a manner to cause a screw advancing stroke of said advancing slide.

30. A screwdriver according to claim 1 in which said automatic index means comprises:

a. means on said body including resilient finger means for shifting the assemblage in the direction of its length toward the path in which said bit is axially moveable; and b. means connected to said shifting means for so operating said shifting means in response to said retractive movement of said bit.

31. A screwdriver according to claim 30 in which said guide means comprises:

a. four surfaces on said body jointly defining a channel intersecting said axial bit path, said channel being of rectangular cross-section and receptive of the assemblage of screws, said resilient finger means projecting through one of said surfaces for engaging the assemblage, two of said surfaces adjacent to said one surface being spaced apart by a distance greater than the length of the screws.

32. A screwdriver according to claim 31 in which two of said surfaces lie in planes parallel to the rotational axis of said bit, the marginal portions of said two surfaces which extend in the direction of strip movement and which lie closer to the retracted position of said bit being recessed to receive the screw heads of the screws still in the assemblage of screws.

33. A screwdriver according to claim 31 in which two of said surfaces lie in planes parallel to the rotational axis of said bit, the marginal portion of one of said two surfaces which extends in the direction of assemblage movement and which lies farther from the retracted position of said bit projecting partially into said channel to reduce its cross-sectional size adjacent to the tip of thd screws still in the strip of screws.

34. A screwdriver according to claim 30 in which said operating means includes a biasing spring for storing strip-shifting energy, said body having at least one internal stop face engageable by said shifting means for limiting the amount of travel thereon in the direction of the length of the strip.

35. A screwdriver according to claim 31 which includes a door pivoted on said body and having an inner side which comprises one of said four surfaces, and a door latch acting between said body and said door.

36. A screwdriver according to claim 35 in which said door latch is detent latch whereby said latch is not attitude-sensitive.

37. A screwdriver according to claim 36 which comprises a spring urging said door toward an open position, said door latch being movably mounted on the door and having a finger with a tip which is slightly enlarged in the direction that said door is urged by said spring, said tip being received in and projecting through an opening in the body.

38. A screwdriver according to claim 31 in which said channel in said body terminates near the place where said next of the screws is disposed.

39. A screwdriver according to claim 8 in which said resilient finger means comprises one said stop finger means disposed between two said driving finger means.

40. A screwdriver according to claim 8 which includes a door pivoted on said body and forming part of said guide means, a door latch acting between said body and said door, said driving finger means acting on the inner side thereof to assist in opening of the door when the door latch is released.

41. A screwdriver according to claim 8 in which said body has an internal stop face engageable by said slider for limiting the travel of said driving finger means in the strip advancing direction.

* * * * *